US011858768B2

(12) United States Patent
Lucia et al.

(10) Patent No.: US 11,858,768 B2
(45) Date of Patent: Jan. 2, 2024

(54) METHOD AND APPARATUS FOR PREPARING EDGES OF REELS OF WEB MATERIAL

(71) Applicants: Fameccanica.Data S.p.A., San Giovanni Teatino (IT); Fondazione Istituto Italiano di Tecnologia, Genoa (IT)

(72) Inventors: Oronzo Lucia, San Giovanni Teatino (IT); Alessandro Cipriani, San Giovanni Teatino (IT); Maurizio Spiriticchio, San Giovanni Teatino (IT); Emanuela Elisa Cepolina, Genoa (IT); Khelifa Baizid, Genoa (IT); Massimiliano Scaccia, Rome (IT); Roberto Gagliardi, San Benedetto del Tronto (IT); Isiah Zaplana, Genoa (IT); Mariapaola D'Imperio, Cittadella (IT); Ferdinando Cannella, Genoa (IT)

(73) Assignees: Fameccanica.Data S.p.A., San Giovanni Teatino (IT); Fondazione Istituto Italiano di Tecnologia, Genoa (IT)

( * ) Notice: Subject to any disclaimer, the term of this patent is extended or adjusted under 35 U.S.C. 154(b) by 176 days.

(21) Appl. No.: 17/505,780

(22) Filed: Oct. 20, 2021

(65) Prior Publication Data

US 2022/0119214 A1 Apr. 21, 2022

(30) Foreign Application Priority Data

Oct. 21, 2020 (IT) ..... 102020000024886

(51) Int. Cl.
*B65H 19/10* (2006.01)

(52) U.S. Cl.
CPC ..... *B65H 19/102* (2013.01); *B65H 2301/463* (2013.01); *B65H 2301/46171* (2013.01); *B65H 2406/34* (2013.01); *B65H 2701/1924* (2013.01)

(58) Field of Classification Search
CPC .... B65H 19/10; B65H 19/102; B65H 19/105; B65H 2406/34; B65H 2301/4604
See application file for complete search history.

(56) References Cited

U.S. PATENT DOCUMENTS

| | | | | |
|---|---|---|---|---|
| 5,366,174 | A | 11/1994 | Tsukamoto et al. | |
| 6,227,088 | B1 | 5/2001 | Cestonaro et al. | |
| 6,808,581 | B2 * | 10/2004 | Kuta | B65H 19/105 242/555.3 |
| 6,814,123 | B2 * | 11/2004 | Erickson | B65H 19/102 242/910 |
| 10,589,951 | B2 * | 3/2020 | Tsujimoto | B65H 19/105 |
| 10,604,367 | B2 * | 3/2020 | Tsujimoto | B65H 19/105 |

FOREIGN PATENT DOCUMENTS

| | | | |
|---|---|---|---|
| EP | 3447013 | A4 | 1/2020 |
| WO | 2008070383 | A1 | 6/2008 |

OTHER PUBLICATIONS

Italian Search Report dated Jul. 28, 2021 (9 pages).

* cited by examiner

*Primary Examiner* — Sang K Kim
(74) *Attorney, Agent, or Firm* — RMCK Law Group PLC

(57) ABSTRACT

A method and an apparatus for preparing an edge of a reel of web material wherein it is envisaged to grip any portion of an external layer of web material of a new reel, removing damaged web material forming loops of the reel, and arranging a leading edge of the new reel to be joined with a tail edge of the reel close to finishing,

8 Claims, 5 Drawing Sheets

METHOD AND APPARATUS FOR PREPARING EDGES OF REELS OF WEB MATERIAL

CROSS-REFERENCE TO RELATED APPLICATION

This application claims priority to Italian Patent Application No. 102020000024886 filed Oct. 21, 2020, The disclosure of the above application is incorporated herein by reference in its entirety.

FIELD OF THE INVENTION

The present invention relates to a method and an apparatus for preparing edges of reels of web material.

The invention has been developed, in particular, regarding its application to the field of producing sanitary articles. In the following description it is understood that the term "sanitary articles" comprises at least the following articles: sanitary absorbent towels, baby diapers, panty diapers, diapers for incontinent adults, bandages, adhesive bandages as for example band aids, as well as face protection masks.

DESCRIPTION OF THE RELATED ART

In machines for producing sanitary articles large quantities of web materials are used, for example non-woven webs. Such web material is typically contained in reels having a width equal to the width of the web material and a diameter in the order of 1-1.5 meters. The leading edge of the web material of the reel is normally glued to the external surface of the reel so as to prevent the end section of web material from unwinding from the reel during transportation.

Modern machines for producing absorbent sanitary articles operate at increasingly higher speeds, so that the unwinding speed of the web materials from the reels tends to an ever-increasing growth, increasing the frequency with which finished reels have to be replaced with new reels. Replacing a finished reel with a new reel needs a set of operations for preparing a leading section of web of the new reel, comprising: searching out the leading end of the wounded web, releasing the edge glued to the external surface of the reel, removing the section of web material forming the outer turns of the reel that are frequently soiled or damaged, and gripping the new leading edge, of the reel, formed after removing the outer turn for joining to the tail edge of a reel close to finishing.

Such operations for preparing a new reel tend to succeed each other at ever shorter intervals as the operating speed of machines increases, therefore there is the need to carry out such operations as fast and efficiently as possible. Particularly, there is the need to carry out all the necessary operations for preparing a new reel automatically and without the intervention of an operator.

Another known problem in the automatic preparation of an edge of non-woven material is the difficulty of gripping the material by means of an automated gripping device due to the characteristic porosity of non-woven webs.

EP-1277683A, by the same Applicant, describes an unwinding assembly that automatically carries out the operations of preparing and joining between a tail section of a web unwinding from a reel close to finishing and a leading section of a new reel. This unwinding assembly provides a first module for dispensing sections of adhesive tape onto a gripping element consisting of a rotating drum. The drum applies the adhesive element onto the outer surface of a reel, so as to establish an adhesive connection with the web wound thereon. Due to a relative movement between the drum and the reel, the web forms a loop separated from the reel, which can be subjected to a second module provided with cutting devices for forming a free edge. Finishing the preparation of the leading edge of the reel for joining to the tail portion of a web of a reel close to finishing requires to provide at least a third module provided with a gripping member for arranging the edge, for example, for the application of a joining adhesive element.

The solution described in the document EP-1277683A involves the need to provide a plurality of separated modules having to act precisely and coordinately, thereby increasing both the risk of malfunctions, which could require the intervention of operators and the slowdown of the operation of reel replacement, and the costs of manufacturing and maintenance and of the unwinding assembly.

DE-4212095C1, U.S. Pat. No. 6,264,132B1 and EP-3150527 describe apparatus and methods for partially preparing the leading edge of a reel, wherein the automatic removal of the section of soiled or damaged web material, forming the outer turns of the reel that will then have to be removed by an operator, is not provided.

Additionally, DE-4212095C1 uses adhesive strips for web material gripping that are applied onto the porous material and then raised by suction cups, whereas US-6264132B1 uses a pair of rollers that creates a loop of material.

Therefore, there is the need for equipment to automatically carry out all the operations for preparing an edge of a reel of web material minimizing the number of necessary modules and devices.

OBJECT AND SUMMARY OF THE INVENTION

The object of the present invention is to provide a method and an apparatus for preparing an edge of a reel of web material that satisfy the aforesaid needs.

Particularly, an object of the present invention is to provide a method and a device for gripping any portion of an external layer of web material of a new reel, removing the web material forming the outer turn of the reel, and arranging a leading edge of the new reel for joining to the tail edge of a reel close to finishing.

According to the present invention, this object is achieved by a method and an apparatus having the characteristics forming the subject of claims 1 and 5.

According to the present invention, gripping of the web is carried out by bringing a friction surface of a gripping device into contact with an external layer of the reel of web material. Such friction surface is coated by a high friction coefficient material, such as sandpaper. Thereafter, the friction surface is pressed onto the roller by a determined force and, by slightly rotating the reel, a loop of web material is formed under which a plate is inserted. Clamping of the portion of material of the loop is carried out by a plurality of suction cups that are arranged so as to be aligned along the whole length of the plate. The suction cups can slide axially and can be lowered onto the plate and operated to grip the portion of material of the loop which, thereafter, can be cut by a blade rotating and moving along the whole reel width.

Removal of the web material forming the outer turns of the reel is obtained by sucking up the outer turn by means of a suction device and, thereafter, by making a second cut of the web material by means of the rotating blade of the gripping device.

BRIEF DESCRIPTION OF THE DRAWINGS

The present invention will now be described in detail with reference to the attached drawings, given purely by way of non-limiting example, wherein.

DETAILED DESCRIPTION

Figure 1:
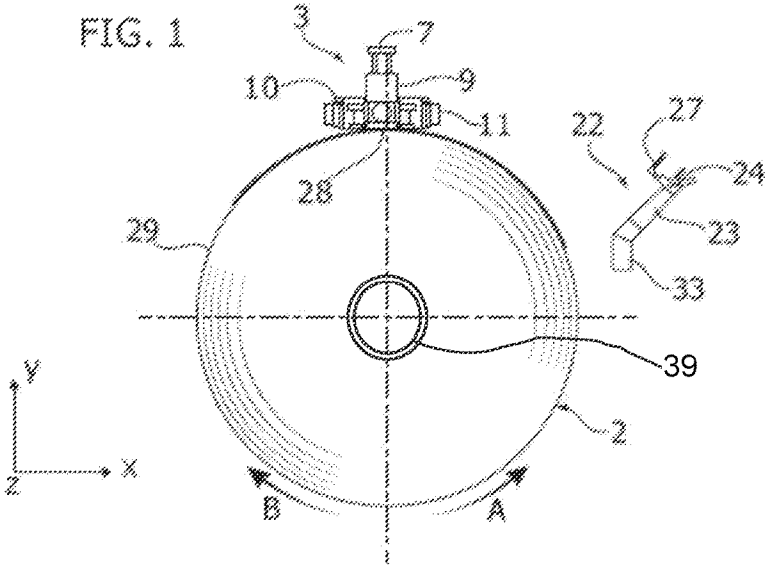
FIGS. 1-8 are schematic views showing the operating sequence for preparing the edge of a reel of web material according to the invention.

In the following description, various specific details are illustrated aimed at a thorough understanding of examples of an embodiment according to the invention. Further embodiments can be implemented without one or more of the specific details, or with other methods, components, materials, etc. In some cases, known structures, materials or operations are not shown or described in detail to avoid obscuring the relevant details of the invention.

With reference to FIGS. 1-8, the operating sequence is represented for automatically preparing a leading edge 1 of a new reel 2 to be joined to the tail edge of a reel close to finishing (not shown in the figures).

Particularly, preparing the leading edge 1 (FIG. 8) of the reel 2 requires releasing the leading end of the web material, normally glued on the external surface of the reel 2 by means of adhesive labels, adhesive, etc., removing the section of web material 29, forming the outer turn of the reel 2, which is frequently soiled or damaged, and gripping the leading edge 1 of the reel 2 formed after removing the outer turn 29 for joining to the tail edge of a new reel.

In FIGS. 1-8, the reel 2 is arranged on a shaft 39 of an automatic unwinding assembly, not fully shown in the figures, rotatable around a first axis Z. Arrow B indicates the web unwinding direction, arrow A the winding one.

Figure 9:
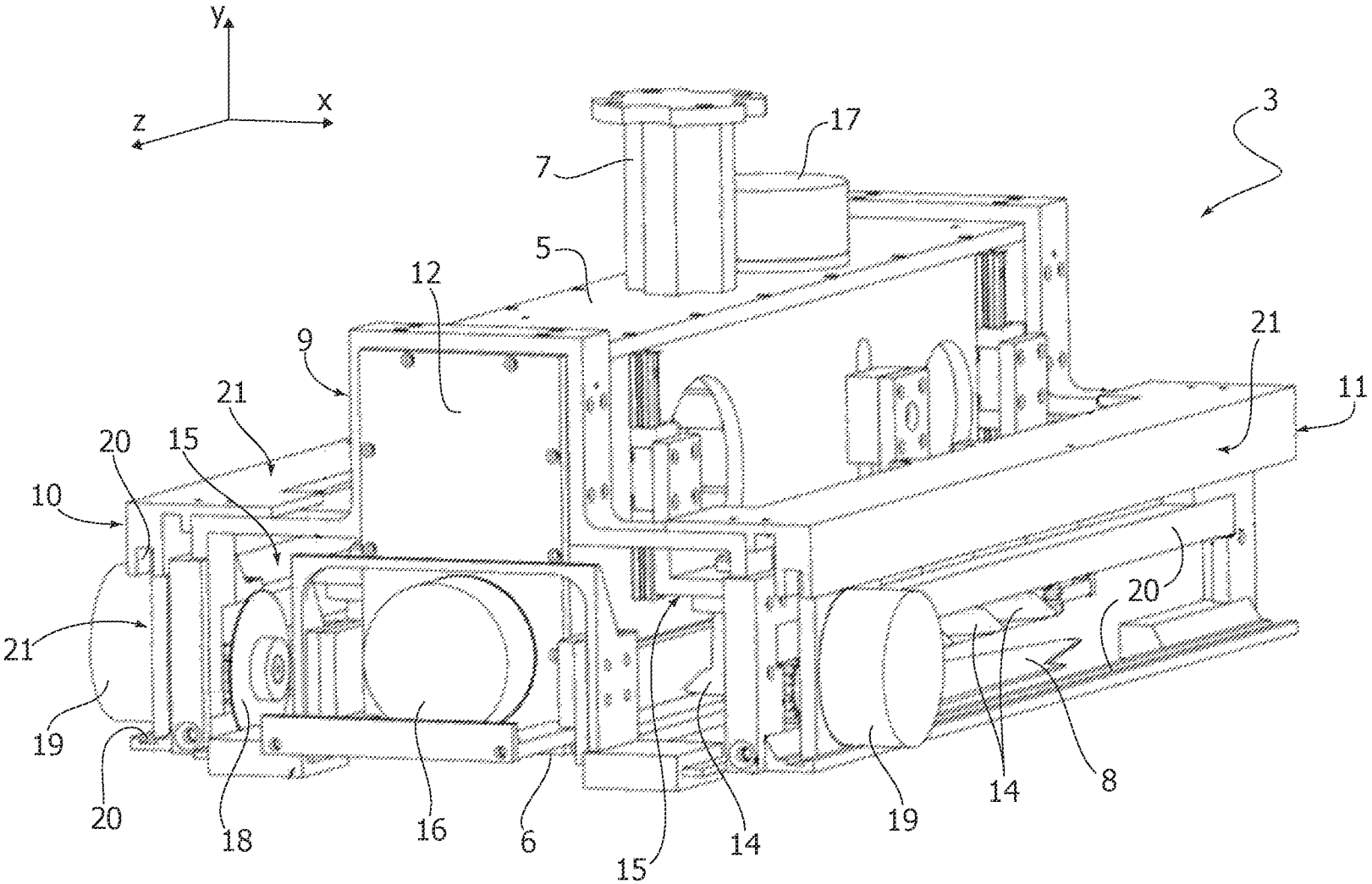
FIG. 9 is a schematic perspective view showing a gripping device according to the invention.
Figure 10:
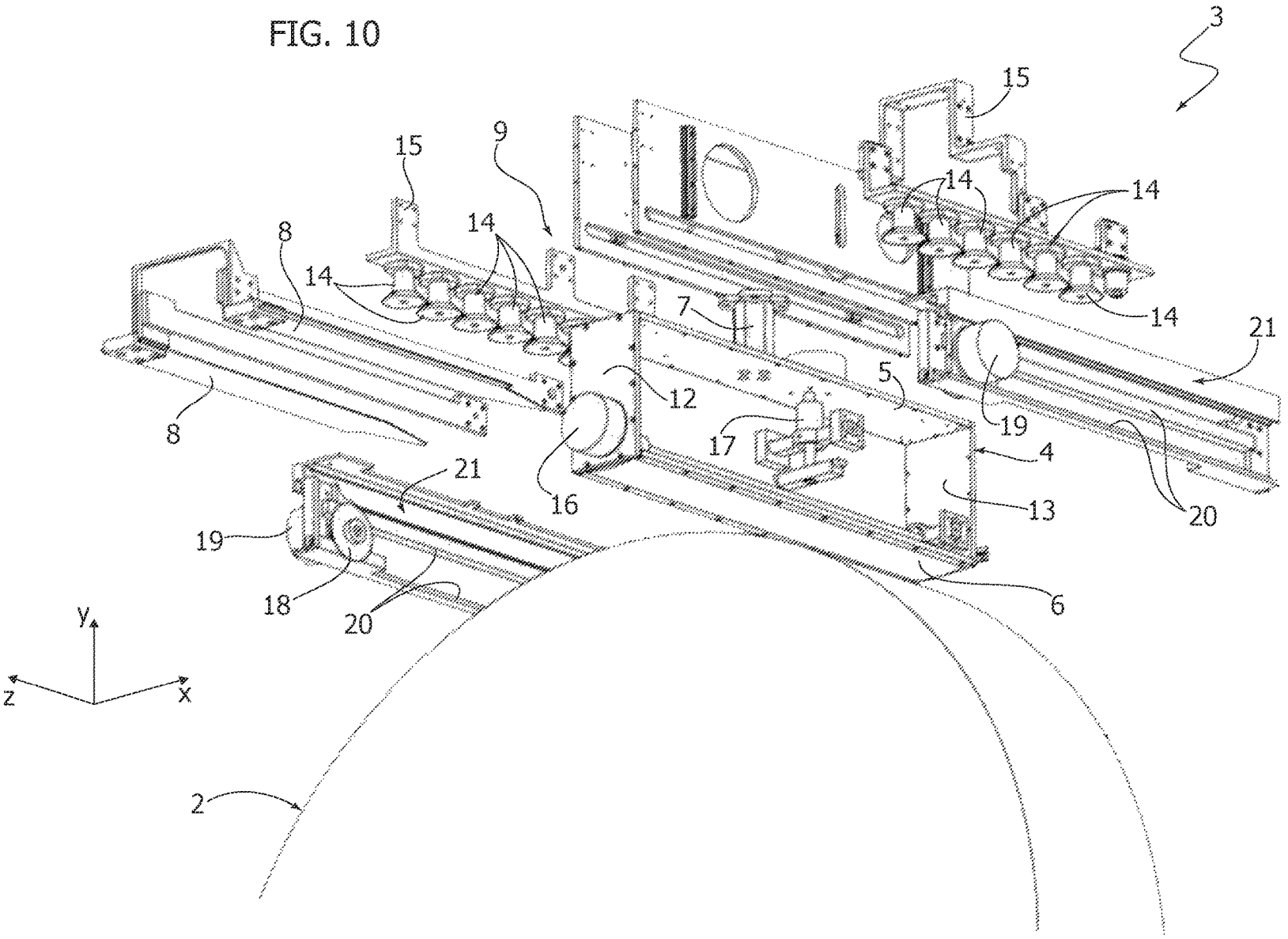
FIG. 10 is an exploded perspective view of FIG. 9.

With reference to FIGS. 9 and 10, the apparatus according to the invention comprises a gripping device 3 movable along at least two axes X, Y orthogonal to the axis Z and rotatable around the axis Z, by means of a handling device, for example the arm of an anthropomorphic robot (not shown in the figures).

In this embodiment, the gripping device 3 comprises a central module 9 provided with a friction surface 6 (whose function will be described hereinafter), and a pair of mirrored side modules 10, 11 each provided with a clamping device and a web cutting device that will be described hereinafter. This feature of the gripping device with two clamping and cutting side modules 10, 11 also allows the method and the apparatus according to the invention to be used for preparing a leading edge of a second reel, located side by side to the reel 2 and arranged on a respective shaft of a module for unwinding and handling reels, not shown in the figures.

In a possible embodiment, the gripping device can comprise a single central module comprising a rectangular shaped casing for housing the clamping and cutting devices and provided with a friction surface arranged on the bottom base thereof.

With reference to FIG. 10, the central module 9 comprises an extended rectangular shaped frame 4 including a top crosspiece 5 having a support 7 for fitting with a robotic handling device, a bottom crosspiece having the friction surface 6, extending parallel to the first axis Z along a length greater than the web width, and a pair of side uprights 12, 13.

In a possible embodiment, the friction surface 6 can have a convex shape and be coated by a high friction coefficient material such as sandpaper. The static friction coefficient between the friction surface 6 and the material of the web has to be greater than the friction coefficient between two overlapped layers of web material of the reel 2.

The clamping device of each of the side modules 10, 11 comprises an extended plate 8 and a plurality of suction cups 14 perpendicular to the plate 8 and carried by a frame 15. Such plate 8 extends parallel to the friction surface 6 and is moveable along a direction parallel to the first axis Z by means of an actuator 16 carried by the side upright 12 of the frame 4. In an embodiment, the plate 8 can have a tapered shape. The suction cups 14 are axially moveable along the axis X by means of an actuator 17.

The cutting device of each of the side modules 10, 11 comprises a rotating blade 18 driven by an actuator 19 and movable along a pair of rails 20 carried by a frame 21 arranged parallel to the plate 8.

Figure 11:
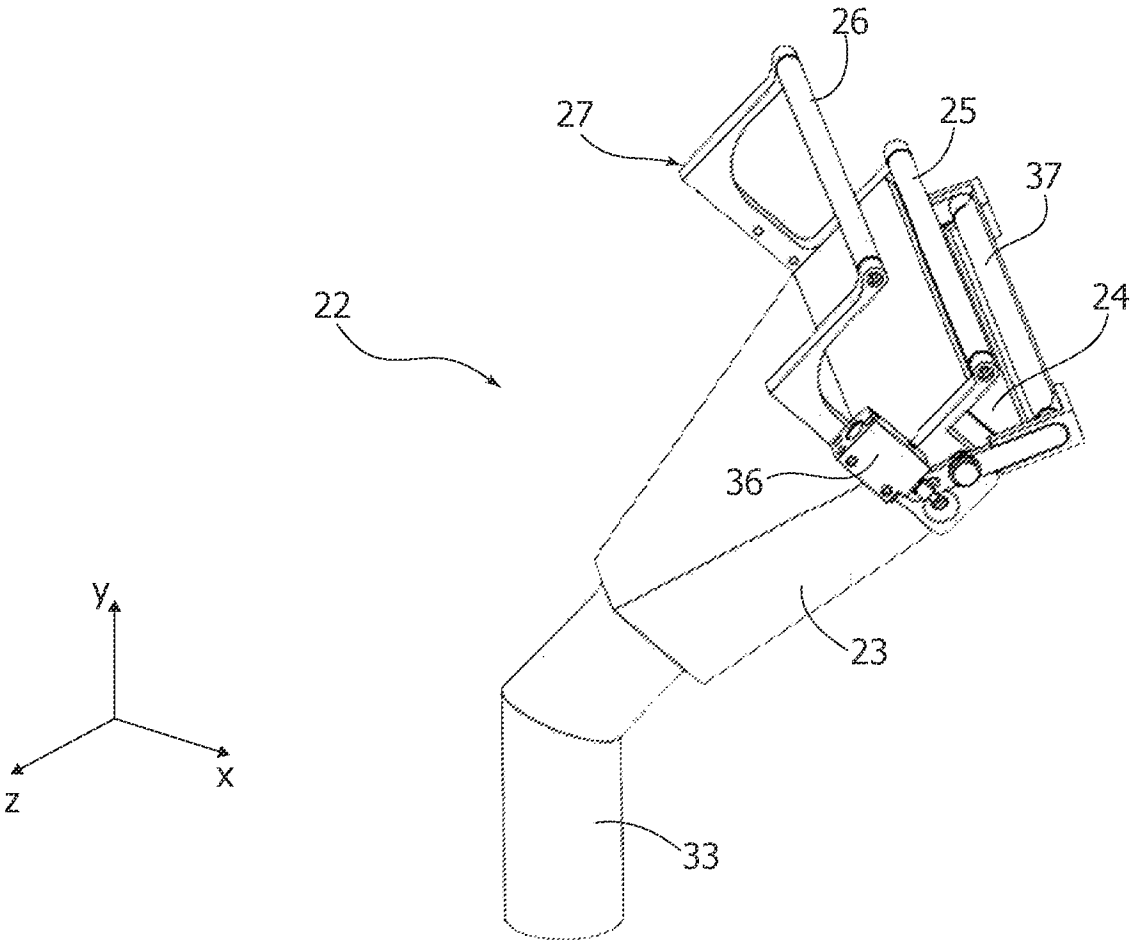
FIG. 11 is a schematic perspective view showing a suction device of a section of web material unwound from the reel.

With reference to FIG. 11, the apparatus according to the invention comprises also a stationary suction device 22 including an extended box-type body 23, provided at its smaller side faces respectively with a top suction mouth 24 and a bottom suction pipe 33 connected to a suction source (not shown). The suction device 22 is also provided with a support for the web material comprising three rollers 25, 26, 37 carried by a frame 27 connected to the box-type body. The rollers, which can be coated by a high friction coefficient material (for example, PVC adhesive band) arranged in strips according to a helicoid to limit the forming of wrinkles in the material during sucking up, are arranged with the rotation axes parallel to the suction mouth 24 of the device 22. The roller 37 is movable by means of an actuator 36 between a rest position in which it is spaced from the roller 25 and a locking position of the material in which it presses against the roller 25.

With reference to FIGS. 1-8, the method according to the invention will now be described for preparing the leading edge 1 of the reel of web material 2.

In FIG. 1, the gripping device 3 is approached and pressed with a predetermined force onto any portion 28 of an outer turn 29 of the web material of the reel 2 arranged on the respective rotatable support shaft. The force applied by the friction surface 6 onto the portion of the web has to be equal to, or greater than, the ratio between the torque necessary to rotate the reel 2 and the product between the radius of the reel and the static friction coefficient between the friction surface 6 and the web material.

Figure 2:
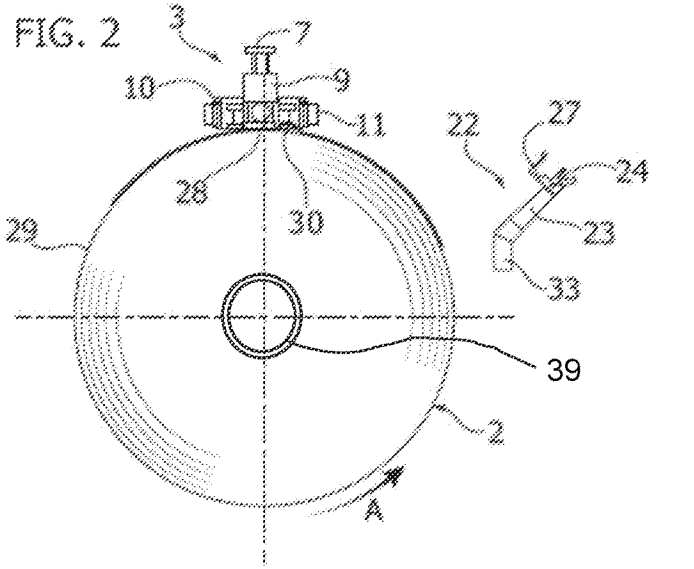

In FIG. 2, the reel 2 is driven into rotation in the winding direction A by a predetermined angle so that the portion of web material downstream of the friction surface 6, with reference to the unwinding direction B of the reel 2, forms a loop 30.

In a possible embodiment, forming the loop 30 is obtained by moving the friction surface 6 of the gripping device 3 along the external surface of the reel by a predetermined length.

Thereafter, the plate 8 of the side module 11 downstream of the central module 9, with reference to the unwinding direction B of the reel 2, is inserted inside the loop 30, the plurality of suction cups 14 of the side module 11 is brought into contact with the external surface of the loop 30 and the suction cups 14 are operated so as to grip the portion of the loop 30 of web material between the plurality of suction cups 14 and the plate 8.

Figure 3:
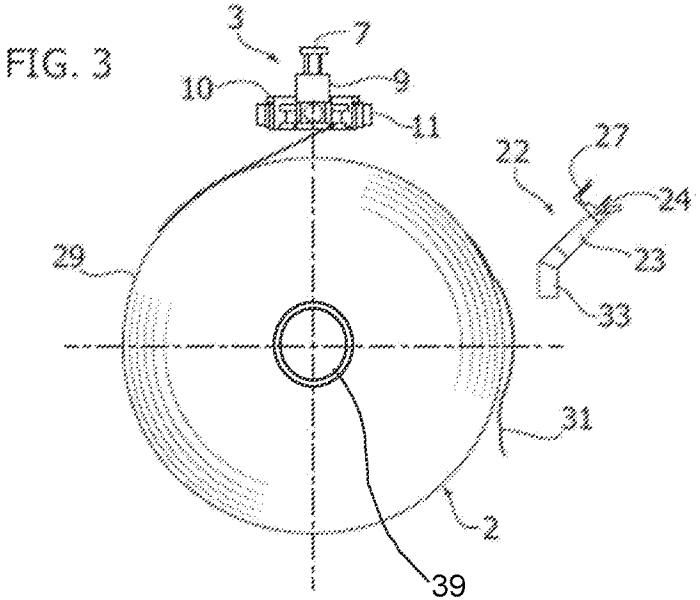

In FIG. 3, the gripping device is moved away from the reel 2 so as to tension the web material to facilitate the cutting thereof and the blade 18 makes a first transversal cut at the portion of material 30. The portion 31 of web material downstream of the cut remains connected to the reel 2 since the end of the web material is glued to the outer turn 29 of the reel 2.

Figure 4:
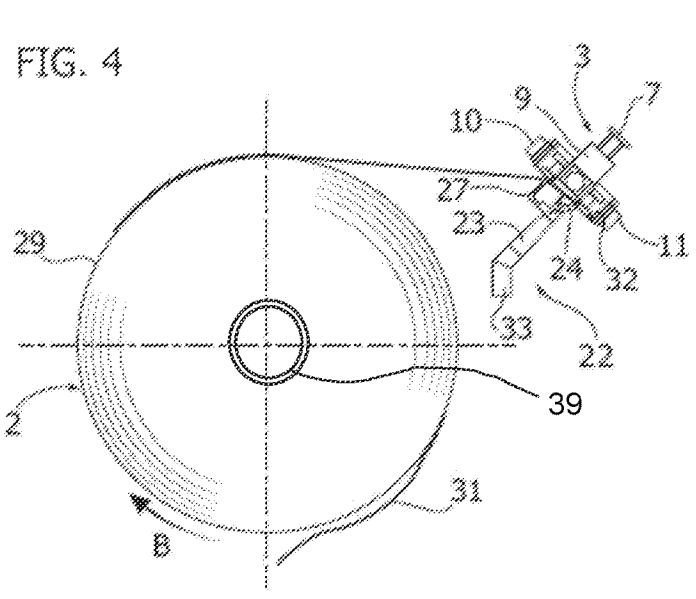

In FIG. 4, the reel 2 is driven into rotation in the unwinding direction B, the gripping device 3 is brought close to the mouth 24 of the suction device 22 so that the end of the web material 32 is gripped by the mouth of the suction device 22, the suction cups 14 are deactivated releasing the clamped portion of material 30 at the rollers 26, 37 of the suction device 22, and the plate 8 is moved away from the suction cups to a rest position.

Figure 5:
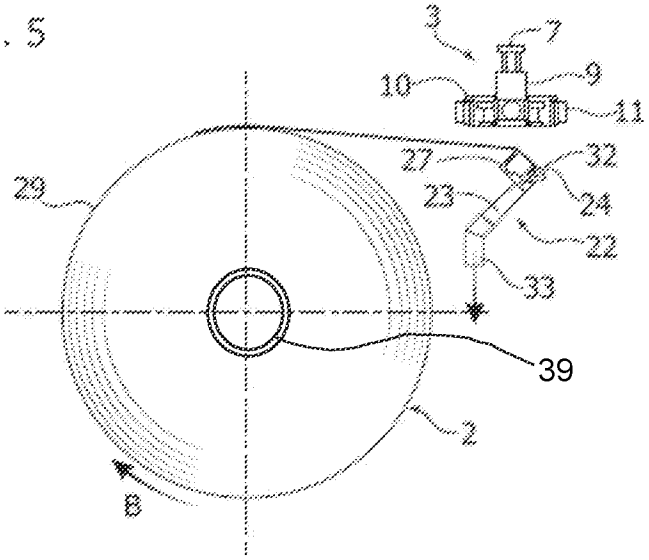

In FIG. 5, the gripping device 3 is moved away from the suction device 22 and, while the end of the web material 32 is sucked up by the suction device 22, a section of web material of a length equal to or greater than the circumference of the reel 2 is unwounded from the reel 2. In this way, all the web material, forming the outer turns 29, normally damaged, together with the part including the portion of previously cut web material 31, is unwounded from the reel 2. The section of web 29 that is unwounded from the reel 2 is sucked up by the suction device 22.

Figure 6:
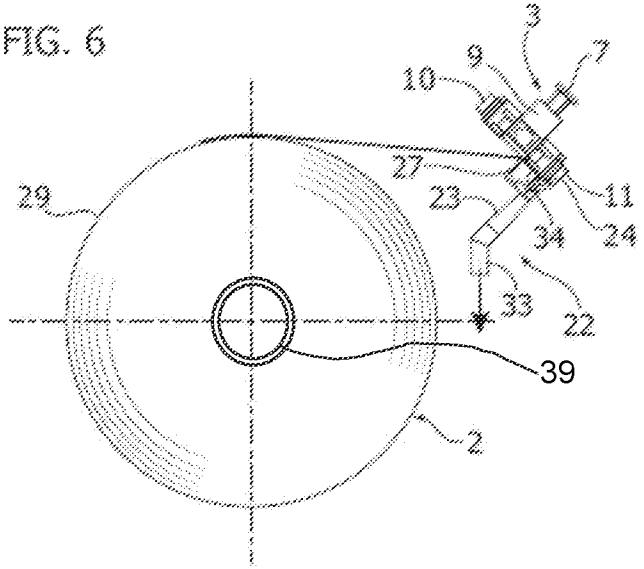

In FIG. 6, the gripping device 3 is brought close to the suction device 22, and the plate 8 and the plurality of suction cups 14 are operated so as to grip the second portion of material 34 in contact with the rollers 25, 26.

Figure 7:
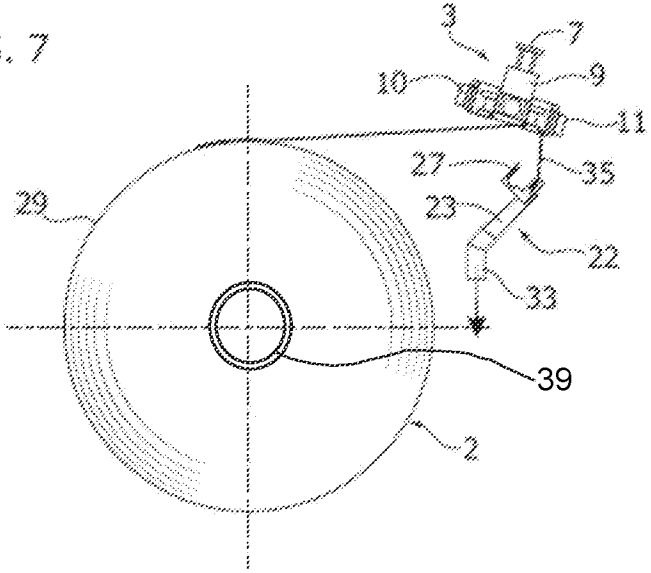

With reference to FIG. 7, at the end of the step of unwinding and sucking up of the section of web forming the outer turns 29 of the reel 2, the gripping device 3 is moved away from the suction device so as to tension the web material in order to facilitate the cutting thereof and the roller 37 is driven into the clamping position of the web material against the roller 25.

Figure 8:
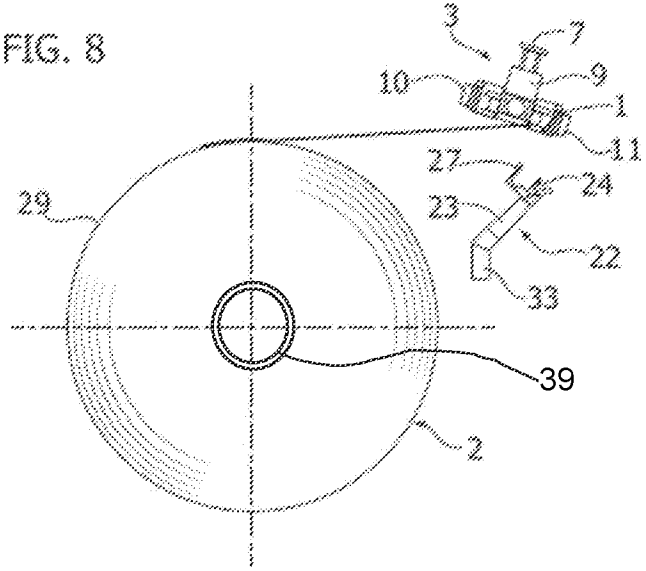

In FIG. 8, the cutting device 18 makes a second transversal cut of the web material downstream of the plate 8 and the portion of the material 35 downstream of the cut is evacuated as scrap into the suction device 22.

The step of preparation of the leading edge 1 of the reel 2 is ended and the edge 1 is ready for the operations necessary to be joined with the edge of a reel close to finishing.

Of course, without prejudice to the principle of the invention, the details of construction and the embodiments can be widely varied with respect to those described and illustrated here, without departing from the scope of the invention as defined by the claims that follow.

The invention claimed is:

1. A method for preparing an edge of a reel of web material, comprising:

placing a reel onto a support shaft rotatable around a first axis, approaching a gripping device movable along at least two axes orthogonal to said first axis and rotatable around said first axis, onto any portion of an outer turn of web material of said reel, pressing a friction surface of said gripping device onto said portion of the outer turn of web material and generating a relative movement between the reel and said friction surface so that said portion of the outer turn of web material forms a loop, inserting at least one plate of said gripping device inside said loop in a direction parallel to said first axis, bringing at least one suction cup of said gripping device into contact with an external surface of said loop, activating said at least one suction cup and clamping a portion of the loop of web material between said at least one suction cup and said at least one plate, making a first transversal cut of the portion of the outer turn of web material at said loop by means of a cutting device of said gripping device, bringing said gripping device close to a mouth of a stationary suction device, gripping an end of said web material by means of said mouth of said suction device, deactivating said at least one suction cup and releasing said gripped portion of web material, unwinding a section of web material with a length equal to or greater than the length of the circumference of the reel, sucking by said suction device said section of web material unwound from the reel, reactivating said suction cup and clamping a second portion of web material between the at least one suction cup and said at least one plate, making a second transversal cut of the section of web material downstream of said at least one plate with reference to an unwinding direction of the reel by means of said cutting device, and evacuating as scrap into said suction device a portion of unwound web material downstream of the cut.

2. The method according to claim 1, wherein said relative movement between the reel and the friction surface to form said loop is obtained by rotating said reel by a predetermined angle or by moving said gripping device along an external surface of the reel of a predetermined length.

3. The method according to claim 1, comprising moving said gripping device away from said reel to tension said web material before making said first and/or said second transverse cut.

4. The method according to claim 1, comprising moving said gripping device away from said suction device between the step of deactivating said at least one suction cup to release said clamped portion of web material and the step of sucking said portion of web material, and bringing said gripping device back to said suction device after said sucking by said suction device step.

5. An apparatus for preparing an edge of a reel of web material, comprising::

a gripping device movable along at least two axes orthogonal to a first axis and rotatable around said first axis, and a stationary suction device provided with a suction mouth, wherein said gripping device comprises:

at least one suction cup, at least one plate movable along a direction parallel to said first axis between a rest position remote from said suction cup and an operating position in which it is opposite to said suction cup, at least one cutting device movable parallel to said first axis, and a friction surface configured to be pressed onto any portion of an outer turn of the web material of said reel so that said portion of the web material forms a loop following a relative motion between said reel and said friction surface, wherein said at least one plate of said gripping device is configured to be inserted into said loop of web material, said at least one suction cup is configured to grip a section of web material against said at least one plate, and said cutting device is configured to cut transversely the portion of web material at said loop, wherein said suction device is configured to suck up the section of web material unwound from the reel, and wherein said cutting device is also configured to make a second transverse cut of the portion of web material downstream of said plate.

6. The apparatus according to claim 5, wherein said friction surface has a convex shape.

7. The apparatus according to claim 5, wherein said gripping device comprises a central module provided with said friction surface, and a pair of mirrored side modules, each side module being provided with the cutting device and a clamping device comprising the at least one suction cup and the at least one plate.

8. The apparatus according to claim 5, wherein said suction device comprises a support for the web material comprising three rollers carried by a frame connected to said suction device and arranged with rotation axes parallel to the suction mouth of the suction device, one of said rollers being movable between a rest position in which it is spaced from an adjacent roller and a clamping position of the web material in which it presses against an adjacent roller of the three rollers.

* * * * *